US006578827B2

(12) United States Patent
McCracken

(10) Patent No.: US 6,578,827 B2
(45) Date of Patent: Jun. 17, 2003

(54) HANDRAIL SYSTEM

(76) Inventor: Ronald G. McCracken, 8924 W. Lane, Magnolia, TX (US) 77355

( * ) Notice: Subject to any disclaimer, the term of this patent is extended or adjusted under 35 U.S.C. 154(b) by 70 days.

(21) Appl. No.: 09/797,269

(22) Filed: Mar. 1, 2001

(65) Prior Publication Data

US 2001/0006231 A1 Jul. 5, 2001

Related U.S. Application Data

(63) Continuation-in-part of application No. 09/388,695, filed on Sep. 2, 1999, and a continuation-in-part of application No. 09/388,522, filed on Sep. 2, 1999.

(51) Int. Cl.[7] ..... E04H 17/14

(52) U.S. Cl. ..... 256/59; 256/24; 256/73; 256/65.14

(58) Field of Search ..... 256/24, 73, 65.14

(56) References Cited

U.S. PATENT DOCUMENTS

| | | | | | |
|---|---|---|---|---|---|
| 3,688,889 | A | | 9/1972 | Koch et al. | |
| 4,030,255 | A | | 6/1977 | Hartman | |
| 4,053,140 | A | | 10/1977 | Clemens et al. | |
| 4,371,148 | A | * | 2/1983 | Harden | 256/26 |
| 4,394,718 | A | | 7/1983 | Balzer | |
| 4,526,347 | A | * | 7/1985 | McLoughlin | 256/33 |
| 4,650,164 | A | | 3/1987 | Shepherd | |
| 4,664,227 | A | * | 5/1987 | Hansen | 182/82 |
| 4,909,483 | A | | 3/1990 | Van Herpen | |
| 4,920,717 | A | | 5/1990 | Hooper, Jr. | |
| 5,145,153 | A | | 9/1992 | Glynn | |
| 5,188,342 | A | * | 2/1993 | Ouellette et al. | 256/65 |
| 5,303,900 | A | | 4/1994 | Zulick, III et al. | |
| 5,356,119 | A | * | 10/1994 | Schock | 256/26 |
| 5,469,682 | A | | 11/1995 | Knight | |
| 5,787,664 | A | | 8/1998 | Hollander et al. | |
| 5,842,685 | A | | 12/1998 | Purvis et al. | |
| 6,039,150 | A | | 3/2000 | Palmer | |
| 6,296,234 | B1 | * | 10/2001 | De Boer | 256/64 |

* cited by examiner

*Primary Examiner*—Anthony Knight
*Assistant Examiner*—Lisa Bannapradist
(74) *Attorney, Agent, or Firm*—Madan, Mossman & Sriram, P.C.; Shawn Hunter

(57) ABSTRACT

Methods and devices for providing temporary handrail systems such as those used to surround the periphery of a building rooftop. A number of handrail sections are reversibly interconnected to one another to form a continuous protective rail. In practice, the rail is quite stable and resistant to tipping. In described embodiments, the handrail systems of the present invention feature load-distributing support bases and weight support platforms. Weights are selectively added to the weight support platforms to anchor the handrail in place. The weight support platforms are located above the surface of the roof and do not contact the roof surface. The weight load is transmitted via a support leg downwardly to a load-distributing support base that is placed in contact with the roof. As a result, the roof membrane is not damaged by a point load applied to it. In addition, a portion of the weight load from the weight support platform is transmitted directly to the vertical support rails of the rail sections. Thus, the rails are more securely anchored in place and have greater resistance to movement of the rail either forwardly or backwardly. The handrail arrangement of the present invention offers improved stability over conventional systems. The rail sections readily interlock to form a continuous rail. The interlocking structure also allows the rail sections to be angled with respect to one another. The interlocking feature increases the stability of the rail.

18 Claims, 3 Drawing Sheets

HANDRAIL SYSTEM

BACKGROUND OF THE INVENTION

This application is a continuation-in-part of U.S. patent application Ser. No. 09/388,695 filed on Sep. 2, 1999 and U.S. patent application Ser. No. 09/388,522 filed on Sep. 2, 1999.

FIELD OF THE INVENTION

The invention relates to temporary safety handrail systems that may be quickly and easily erected or removed and, in particular aspects, the invention relates to handrail systems that use weighted counterbalancing.

DESCRIPTION OF THE RELATED ART

Temporary safety handrails are important to provide protection against falling for workers on building roofs. These structures also help prevent equipment or items from falling or being blown off of roofs and injuring individuals below. Safety rails generally, of course, are useful in many other situations as well.

Some temporary handrail systems are known that use weighted counterbalancing to stabilize the handrail. U.S. Pat. No. 5,145,153 issued to Glynn and entitled "Portable Handrail Counter-Weight System" describes a modular portable handrail system that employs cantilever arm/counterweight anchor assemblies. Unfortunately, this system has a number of problems that limit its effectiveness. For example, the system has roof-contacting portions with sharp corners and edges that can damage the roof membrane and cause the roof to leak.

U.S. Pat. No. 4,909,483 issued to Van Herpen and entitled "Support for the Handrail of a Detachable Handrail Unit" describes a safety handrail for the tops of buildings and the like. The rail has several "bases" that are horizontally disposed offset legs that rest upon the rooftop. The ends of offset legs are weighted down by placing weights onto the leg and the rooftop surface. Because the weight and the base both contact the roof, they can cause damage to the roof membrane from their sharp corners and edges.

Conventional weighted handrail systems have other disadvantages in operation. The weights in these systems are generally applied only to the offset end of the horizontal leg. This is an inefficient means of anchoring a rail in place. The rail may be pulled or pushed backwardly and lifted off of the roof. The weighted end of the leg can act as a fulcrum about which the rail assembly could rotate. As a result, stability of the rail is problem.

Many conventional weighted handrail systems also fail to adequately distribute weight loads across the surface of a roof. As a result, significant amounts of weight are applied to specific points on the sometimes delicate roof membrane thereby resulting in damage to the rooftop.

It would be desirable to have systems and methods that address the problems associated with the prior art.

SUMMARY OF THE INVENTION

The present invention is directed to methods and devices for providing temporary handrail systems. In a preferred application, the handrail systems of the present invention are used to surround the periphery of a building rooftop. A number of handrail sections are reversibly interconnected to one another to form a continuous protective rail. In practice, the rail is quite stable and resistant to tipping.

In exemplary embodiments, the handrail systems of the present invention feature load-distributing support bases and weight support platforms. Weights are selectively added to the weight support platforms to anchor the handrail in place. The weight support platforms are located above the surface of the roof and do not contact the roof surface. The weight load is transmitted via support legs downwardly to load-distributing support base that is placed in contact with the roof. The support bases are substantially devoid of sharp edges and corners and distribute the weight load so that point loading is not a problem. As a result, the roof membrane is not damaged by a point load applied to it. In addition, a portion of the weight load from the weight support platform is transmitted directly to the vertical support rails of the rail sections. Thus, the rails are more securely anchored in place and have greater resistance to movement of the rail either forwardly or backwardly.

The handrail arrangement of the present invention offers improved stability over conventional systems. The rail sections readily interlock to form a continuous rail. The interlocking structure also allows the rail sections to be angled with respect to one another. The interlocking feature increases the stability of the rail.

DETAILED DESCRIPTION OF THE PREFERRED EMBODIMENTS

Figure 1:
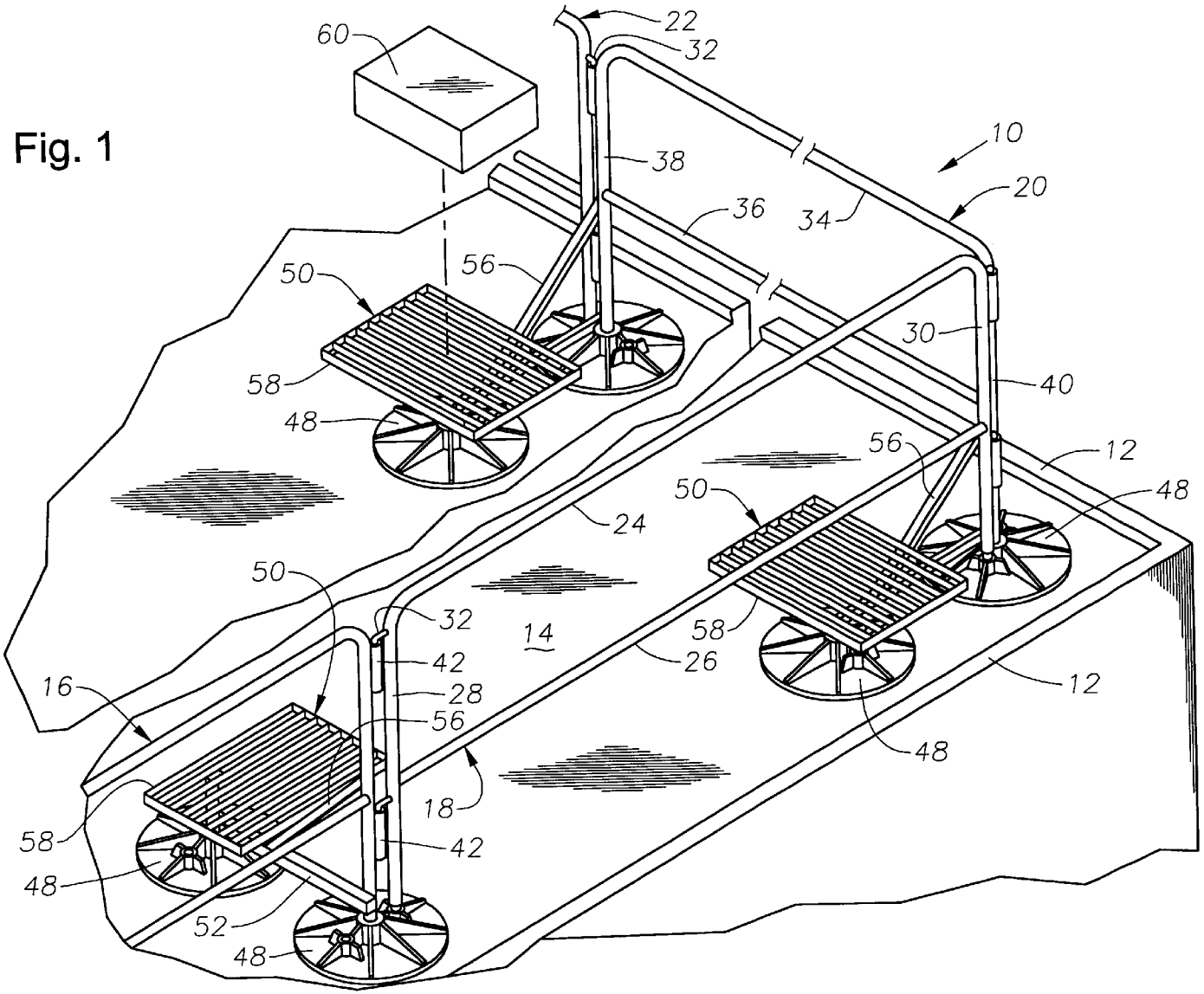
FIG. 1 is an isometric view of an exemplary assembled handrail constructed in accordance with the present invention.
Figure 2:
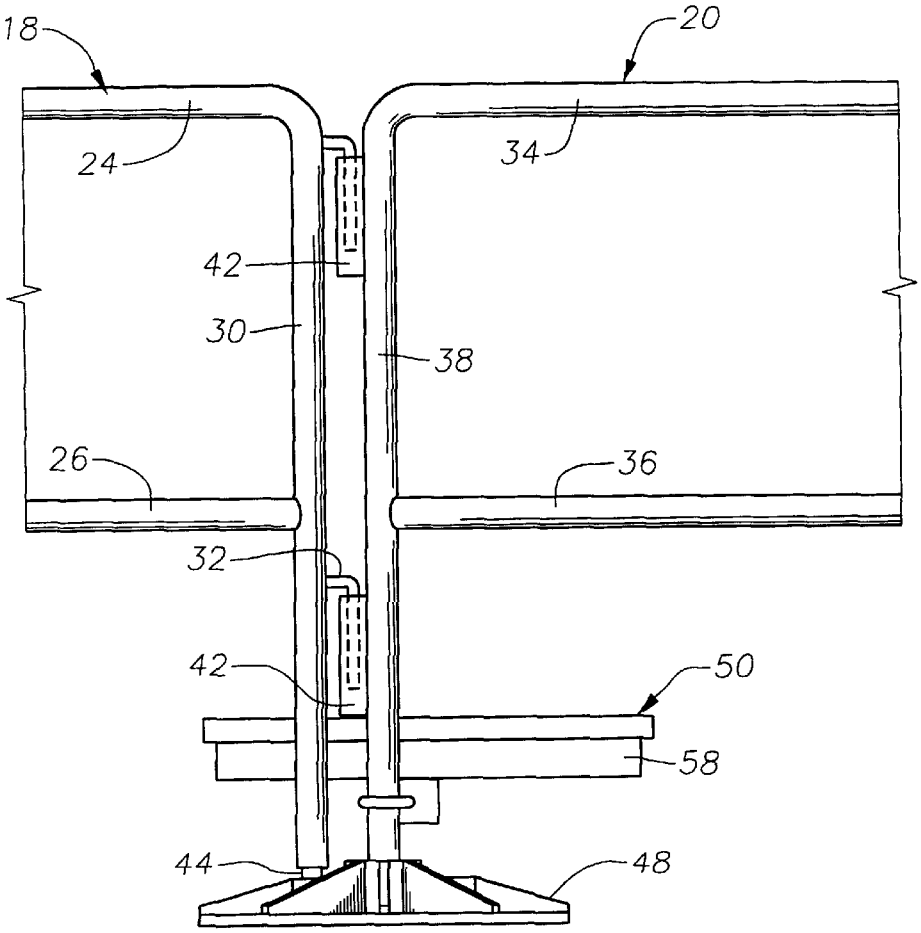
FIG. 2 is an isometric view of a pair of reversibly interconnectable handrail sections, constructed in accordance with the present invention.

FIGS. 1 and 2 illustrate an exemplary safety handrail or guardrail system 10 that is constructed in accordance with the present invention. FIG. 2 illustrates the system 10 emplaced in a currently preferred location which is the edges 12 of a building roof 14. The handrail system 10 includes a plurality of handrail sections 16, 18, 20, 22 that are reversibly connectable to one another to form a continuous rail.

Figure 3:
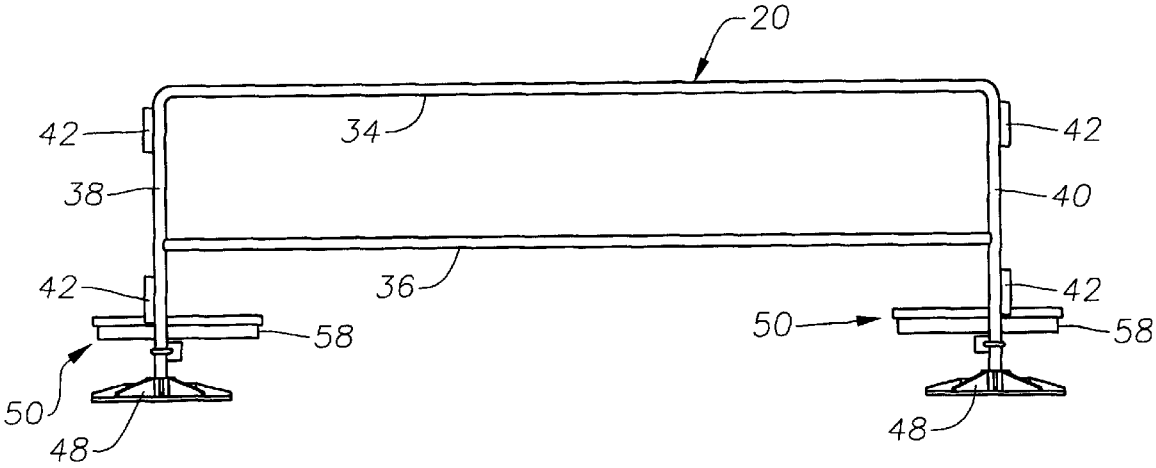
FIG. 3 is a front view of a first type of single handrail section.
Figure 4:
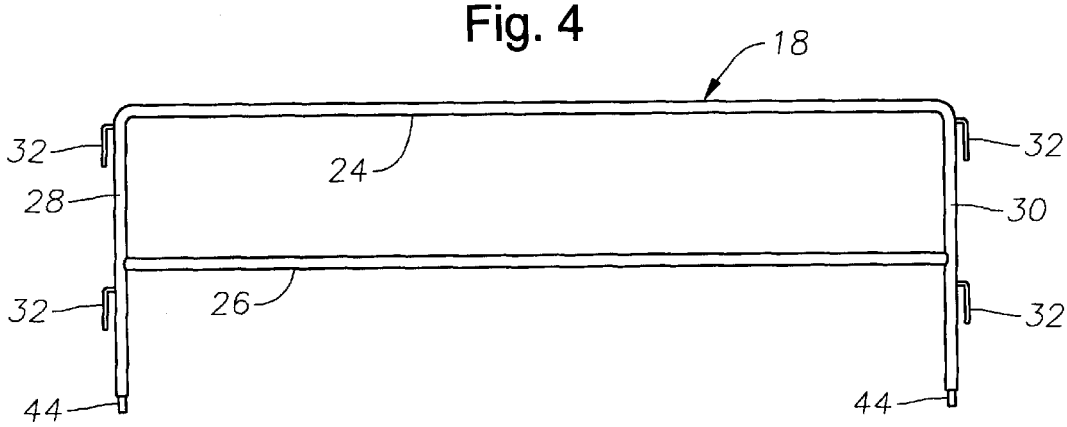
FIG. 4 is a front view of a second type of single handrail section.
Figure 5:
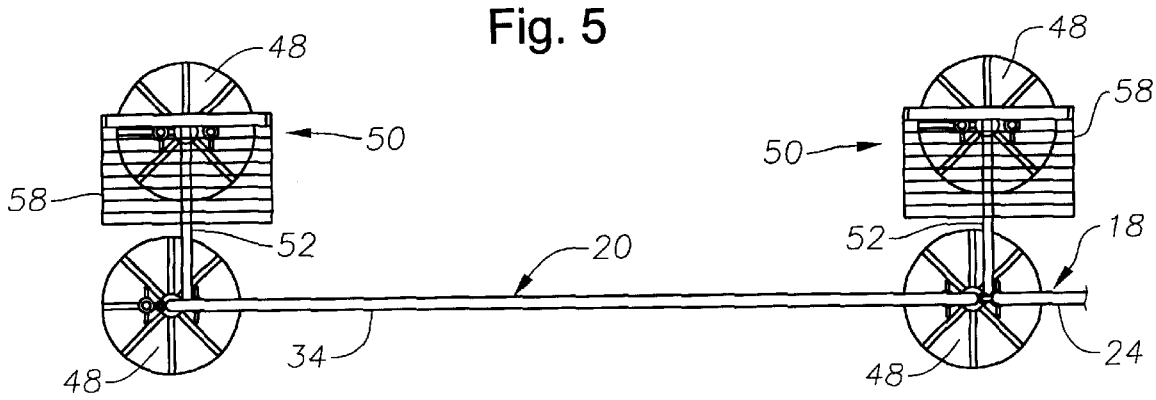
FIG. 5 is a plan view of a pair of interconnected handrail sections.
Figure 6:
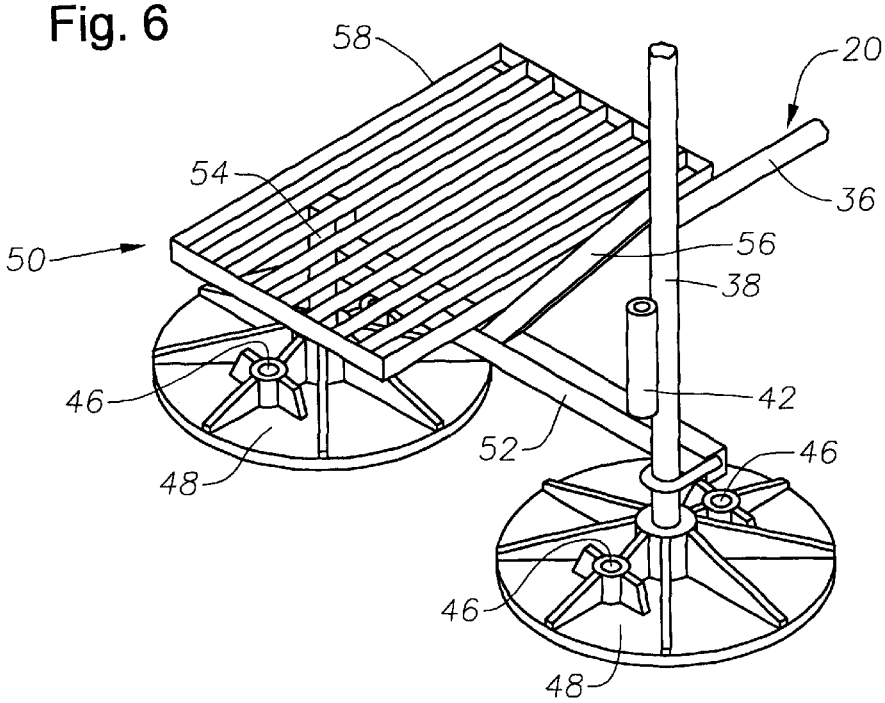
FIG. 6 shows a portion of a handrail section.

Assembly and disassembly of the handrail sections 16, 18, 20, 22 can be appreciated by reference to the structure of individual handrail sections as either shown in FIGS. 2, 3, 4, 5 and 6. FIG. 4 shows handrail section 18 apart from the other components. As is apparent from FIG. 4, handrail section 18 is one of two types of handrail sections that make up the handrail system 10. Sections 18 and 22 are this first type of handrail section while sections 16 and 20 are the second type of handrail section. As will be described, the two types of handrail sections are complimentary to one another so that they may be assembled together to form a continuous rail.

Handrail section 18 includes of a pair of horizontal rail members 24, 26 that are provided for protection of an individual against falling from the roof 14. Each of the horizontal rail members 24, 26 is securely affixed to a vertical side rail 28, 30 on each of its ends. The currently preferred method of affixing the rails to one another is by welding. Each of the vertical rails 28, 30 includes a pair of male connectors 32 that are depicted as being L-shaped brackets securely affixed to the side of the each vertical rail 28, 30 opposite the horizontal rails 24, 26.

A second type of handrail section 20 is shown in FIG. 3. The second type of handrail section 20 includes a pair of horizontal rail members 34, 36 and affixed vertical rails 38, 40 at each end of the horizontal rail members 34, 36. Female connectors 42 securely affixed to the vertical rails 38, 40 on the side opposite the horizontal rail members 34, 36. The female connectors 42 are essentially tubes that are sized and shaped to receive therein the L-shaped brackets 32 of an adjacent handrail section 18 as best shown by FIG. 2. Interconnection of the male connectors 32 and female connectors 42 provides a joint or hinge-type connection between adjacent rail sections so that the adjacent sections may form angles. As FIG. 1 shows rail sections 18 and 20 set at an approximate 90 degree angle to one another to accommodate a corner of the roof 14.

Typically, the vertical rail members 28, 30, 38, 40 and horizontal rail members 24, 26, 34, 36 are made of 1 and ¼" round steel pipe sections, although other suitable sizes, shapes and materials could also be used. A currently preferred height for both types of handrail sections 18 and 20 is 3'7½", although these handrail sections may be fashioned to be other heights if desired. Additionally, while two horizontal rails are shown for each of the handrail sections 18, 20, it should be understood that there may be only one such horizontal rail, if desired. Alternatively, there may be more than two horizontal rails.

The lower ends of each of the vertical rail members 28, 30, 38, and 40 have reduced diameter pins 44 which are best seen in FIGS. 3 and 4. The pins 44 are shaped and sized to reside within openings 46 on load-distributing bases 48. The bases 48 are preferably circular bases of the type described in U.S. Pat. No. 5,816,554 entitled "Equipment Support Base" which is currently owned by the inventor of the present invention. That patent is incorporated herein by reference. The bases 48 serve to distribute the weight load of the handrail system 10 upon the roof 14 so as to prevent dangerous point loading of the rooftop.

Each longitudinal end of the second type of handrail section (i.e., 16 or 20) includes a pair of weight support platform assemblies, designated generally by the reference numeral 50, located at each longitudinal end of the handrail section. The first type of handrail section (i.e. 18 or 22) does not have a weight support platform at either of its ends. Construction and operation of the weight support platform assemblies 50 is best understood with reference to FIGS. 1, 5 and 6. As shown, the assemblies 50 include a horizontally-disposed arm 52 that is secured to and extends laterally from the vertical rail member 38, 40. The arm 52 is affixed to a leg 54, which is partially visible in FIG. 6. The leg 54 has a pin at its lower end that is shaped and sized the same as the pins 44 described earlier so that the leg 54 may be affixed to a base 48 as well. A strut 56 extends between the horizontal arm 52 and the vertical rail member (either 38 or 40). The strut 56 is angled upwardly from the leg 54 to the vertical rail member (38 or 40).

A horizontally-disposed weight support platform 58 is secured, preferably by welding, to the top surfaces of the horizontal arm 52, leg 54 and strut 56. The weight support platform 58 is provided by a metallic grid that forms apertures which permit airflow and drainage therethrough.

Weights, such as the exemplary weight 60 depicted in FIG. 1, may be placed upon the platform 58 to help anchor the handrail system 10 in a stable manner. The weight 60 may comprise any suitable weighted load, including bricks, concrete blocks, sandbags and the like. The weight support platform 58 transmits the weight load of the weight 60 to both the rear leg 54 and the vertical rail member (38 or 40). Weight loading is transmitted to the vertical rail member (38 or 40) via the strut 56. Distribution of the weight loads to both the vertical rail member and the rear leg 54 results in a balanced weighting for the rail system 10. The load distributing bases 48 receive the weight load from the weight support platforms 58 and transmit the weight load to the roof surface 14 in an evenly distributed manner.

The handrail system of the present invention provides a number of advantages over conventional arrangements. The modular nature of the rail sections permits discrete prefabricated lengths of rail to be easily stored and transported to a worksite. The handrail sections 18, 20 may be fashioned in any length. Currently, however, it is believed that lengths of around 10 feet are optimal as these are sufficiently short to be easily transportable.

While a preferred embodiment of the invention has been set forth for purposes of illustrating the invention, the foregoing description should not be deemed a limitation of the invention herein. Various modifications, adaptations and alterations may occur to one skilled in the art without departing from the scope and spirit of the invention.

What is claimed is:

1. A safety handrail assembly for placement upon a support surface, the handrail assembly comprising:

a) a plurality of handrail sections that are reversibly interconnectable to one another in an adjacent, end-to-end relation;

b) each of said handrail sections having:

1) a substantially horizontally disposed rail member having two ends;

2) a substantially vertically disposed rail member affixed to each end of the substantially horizontally disposed rail member;

c) a weight support portion having:

a weight support platform for placement of stabilizing weights thereupon; and at least one connecting member extending between the weight support platform and one of the substantially vertically disposed rail members, the connecting member securing the weight support platform at a height above the support surface.

2. The handrail assembly of claim 1 further comprising a connector assembly for securing adjacent handrail sections to one another in an end-to-end relation.

3. The handrail assembly of claim 1 wherein the weight support portion further comprises a load distributing base to contact the support surface, the load distributing base receiving a weight load from the weight support platform and transmitting it to the support surface.

4. The handrail assembly of claim 3 wherein the weight support portion further comprises a support leg that transmits the weight load from the weight support platform to the load-distributing base.

5. The handrail assembly of claim 3 further comprising a brace member that transmits a portion of the weight load and transmits said portion of said weight load to the substantially vertically disposed rail member.

6. The handrail assembly of claim 2 wherein the connector assembly comprises a male connector and a female connector.

7. The handrail assembly of claim 6 wherein the male connector comprises an L-shaped bracket and the female connector comprises a receptacle that is shaped and sized to receive a portion of the L-shaped bracket.

8. A safety handrail assembly comprising:

a plurality of handrail sections that are reversibly interconnectable to one another in an end-to-end relation; and a plurality of load distributing bases, each of the load distributing bases being affixable to lower end of a handrail section to distribute weight loads associated with the handrail sections across a support surface, each of the bases having a round footprint and lacking sharp corners that might puncture a roof membrane.

9. The safety handrail system of claim 8 further comprising at least one weight support platform associated with a handrail section for the placements of weights thereupon to help stabilize the handrail system.

10. The handrail system of claim 8 further comprising a male connector and a female connector for securing adjacent handrail sections to one another in an end-to-end relation.

11. The handrail system of claim 10 wherein the male connector comprises a substantially L-shaped bracket and the female connector comprises a tube that is shaped and sized to receive the bracket therein.

12. The handrail system of claim 9 wherein the weight support platform comprises a metallic grid that forms apertures which permit airflow and drainage therethrough.

13. The handrail system of claim 9 further comprising a vertically disposed leg and an angled strut that support the weight support platform and transmit a weight load from the weight support platform to both the vertically disposed leg and portion of the handrail section.

14. The handrail system of claim 8 wherein each of the handrail sections comprises a pair of substantially vertically disposed members and at least one substantially horizontally disposed member interconnecting the substantially vertically disposed members.

15. A safety handrail assembly for placement upon a support surface, the safety handrail assembly comprising:

a first handrail section having:

a) at least one a substantially horizontally disposed rail member having two ends;

b) a substantially vertically disposed rail member affixed to each end of the substantially horizontally disposed rail member; and c) a weight support portion secured to each vertical rail member, the weight support portion comprising:

a weight support platform;

at least one connecting member securing the weight support platform to the vertical rail member so that the weight support platform is disposed above the support surface;

a second handrail section having:

a) at least one a substantially horizontally disposed rail member having two ends;

b) a substantially vertically disposed rail member affixed to each end of the substantially horizontally disposed rail member;

c) no weight support portion secured to any substantially vertically disposed rail member; and the first and second handrail sections being reversibly interconnectable to one another in an end-to-end relation.

16. The safety handrail assembly of claim 15 further comprising a load-distributing base having a circular footprint and securable to a lower end of a substantially vertically disposed rail member.

17. The safety handrail assembly of claim 15 further comprising a connecting assembly for reversibly interconnecting the first and second handrail sections, the connecting assembly comprising:

an L-shaped male connector fixedly secured to a substantially vertically disposed rail member of the second handrail section; and a complimentary female connector fixedly secured to a substantially vertically disposed rail member of the first handrail section, the female connector defining a tube to receive the male connector therein.

18. The safety handrail assembly of claim 16 wherein the lower end of said vertical rail member comprises a reduced diameter pin for seating of the vertical rail member into said base.

* * * * *